US008360750B2

(12) United States Patent
Ferk et al.

(10) Patent No.: US 8,360,750 B2
(45) Date of Patent: Jan. 29, 2013

(54) PUMP DEVICE

(75) Inventors: Bernd Ferk, Bad Bramstedt (DE); Gunnar Gode, Techau (DE); Henning Ladiges, Uetersen (DE); Dirk Petersen, Travenbrueck (DE); Uwe Schade, Quickborn (DE); Wilfried Tille, Luebeck (DE)

(73) Assignee: Bran+Luebbe GmbH, Norderstedt (DE)

( * ) Notice: Subject to any disclaimer, the term of this patent is extended or adjusted under 35 U.S.C. 154(b) by 0 days.

(21) Appl. No.: 11/896,524

(22) Filed: Sep. 4, 2007

(65) Prior Publication Data

US 2008/0056916 A1 Mar. 6, 2008

(30) Foreign Application Priority Data

Sep. 4, 2006 (DE) ..... 10 2006 041 420

(51) Int. Cl.
*F04B 9/08* (2006.01)
*F04B 43/06* (2006.01)
*F04B 35/00* (2006.01)

(52) U.S. Cl. ..... 417/389; 417/395; 417/404

(58) Field of Classification Search ..... 417/395, 417/393, 397, 389, 375, 404
See application file for complete search history.

(56) References Cited

U.S. PATENT DOCUMENTS

| | | | | | |
|---|---|---|---|---|---|
| 2,653,552 | A | * | 9/1953 | Geeraet | 417/317 |
| 2,667,129 | A | * | 1/1954 | Graner | 417/326 |
| 2,703,055 | A | * | 3/1955 | Veth et al. | 417/205 |
| 2,780,177 | A | * | 2/1957 | Hoenecke | 417/395 |
| 2,951,450 | A | * | 9/1960 | Fisher | 417/273 |
| 3,072,462 | A | * | 1/1963 | Anderson | 422/131 |
| 3,101,058 | A | * | 8/1963 | Carr, Jr. et al. | 417/388 |
| 3,357,360 | A | * | 12/1967 | Borell | 417/390 |
| 3,630,642 | A | | 12/1971 | Osterman | |
| 3,779,384 | A | * | 12/1973 | Stahlkopf | 210/136 |
| 3,838,946 | A | * | 10/1974 | Schall | 417/395 |
| 4,386,888 | A | * | 6/1983 | Verley | 417/393 |
| 4,708,827 | A | * | 11/1987 | McMillin | 261/35 |
| 5,279,504 | A | * | 1/1994 | Williams | 417/393 |
| 5,332,372 | A | * | 7/1994 | Reynolds | 417/393 |
| 6,554,578 | B1 | * | 4/2003 | Siegel | 417/53 |

FOREIGN PATENT DOCUMENTS

| | | | |
|---|---|---|---|
| DE | 1084486 | B | 6/1960 |
| DE | 3710013 | A1 | 10/1987 |
| DE | 3700547 | C2 | 12/1990 |
| DE | 4122538 | A1 | 1/1993 |
| DE | 19903052 | B4 | 11/2007 |
| EP | 0 011 022 | | 5/1980 |
| EP | 0085725 | A1 | 8/1983 |
| GB | 2003976 | A | 3/1979 |

(Continued)

*Primary Examiner* — Charles Freay
*Assistant Examiner* — Alexander Comley
(74) *Attorney, Agent, or Firm* — Baker & Hostetler LLP

(57) ABSTRACT

The present invention relates to a pump device with a first diaphragm pump head having two or an integral multiple of two fluid delivery chambers and diaphragms associated therewith, which are hydraulically coupled to a second diaphragm pump head. The second diaphragm pump head has two additional fluid delivery chambers and additional membranes associated therewith, which are drivable by a double-acting piston via associated diaphragm control chambers, a refilling valve being connected in each case to the diaphragm control chambers and the diaphragm control chambers being temporarily impinged with a diaphragm control pressure, which is greater than atmospheric pressure, using the refilling valve. The piston may thus be activated using a relatively small force to achieve a delivery action.

18 Claims, 1 Drawing Sheet

FOREIGN PATENT DOCUMENTS

| | | | |
|---|---|---|---|
| JP | S54-51004 | A | 4/1979 |
| JP | H02248671 | A | 10/1990 |
| JP | H09-502245 | A | 3/1997 |
| JP | 2001-317465 | A | 11/2001 |

* cited by examiner

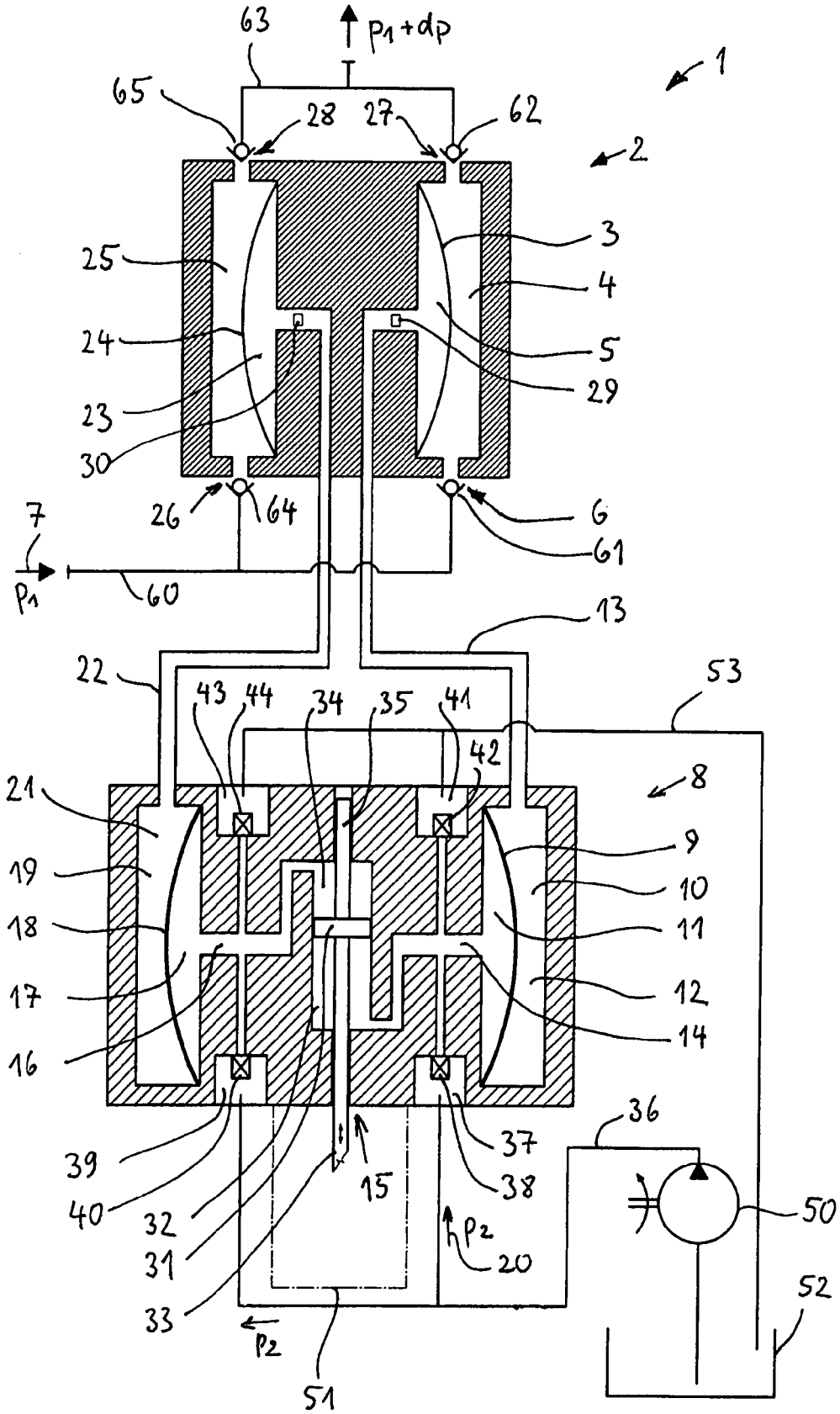
p1+dp
1
2
63
65
28
27
62
3
25
4
24
5
29
23
30
26
64
6
61
7
p1
60
13
22
53
43
44
34
35
41
42
8
21
9
19
10
18
11
17
12
16
14
39
40
32
31
33
15
37
38
36
50
p2
20
52
p2
51

PUMP DEVICE

CROSS-REFERENCE TO RELATED APPLICATIONS

This application claims priority of German Patent Application No. 102006041420.9, filed Sep. 4, 2006, the disclosure of which is hereby incorporated by reference in its entirety.

FIELD OF THE INVENTION

The present invention relates to a pump device having a first diaphragm pump head and a second diaphragm pump head hydraulically coupled thereto.

BACKGROUND OF THE INVENTION

Piston pumps may be used to deliver and/or recirculate viscous media having a high proportion of solids (suspensions) at high pressures of greater than 200 bar and high temperatures of greater than 300° C. However, they are only suitable in a limited way for an application of this type, because the solid components destroy associated seals of a piston in a relatively short time and cause scoring on a surface of the piston.

A possibility for avoiding these difficulties is to use diaphragm pumps. To implement delivery at the above-mentioned pressures, only designs having hydraulically driven diaphragms may be used. In turn, these may only be conceived for secure and interference-free operation in the cited temperature range with significant design and material technology outlay.

The use of plastic diaphragms made of PTFE, for example, is not possible, because plastic begins to flow significantly at the cited high pressure and high temperature. The use of metal diaphragms is possible in principle, but technical demands such as multilayered diaphragms having fracture signaling and an embodiment as a diaphragm oscillating freely in the product space having position control may only be implemented with great effort, see EP 0 085 725 A1.

Up to this point, pumps having a so-called remote valve head have been used as a measure against the high temperature strain. In such a design, a diaphragm pump operates as an upstream pulsator, which actuates the operating valve in the downstream remote valve head of the pump with the aid of the fluid to be delivered via a pipeline acting as a cooling line. In this way, the diaphragm pump may operate in the noncritical low temperature range up to approximately 150° C. However, it is disadvantageous that possible solid components of the fluid to be delivered may clog the pipeline between the upstream pulsator and the remote valve head and thus impair the delivery effect.

The high pressure of the fluid to be delivered results in a further problem. The piston rod force of oscillating displacement pumps, which results from the product of pressure and area, requires the use of very large pump drive assemblies in certain circumstances, which may be uneconomical in two regards for the required application. Firstly, significantly higher investment costs and secondly higher life cycle costs are connected thereto, which may be particularly distinguished by energy costs and outlay for wearing and replacement parts. The economic consideration of pump systems for recirculation having the boundary conditions cited above is especially of very great significance in methods for energy reclamation from biological wastes.

SUMMARY OF THE INVENTION

It is therefore an object of the present invention to provide a pump device which may reliably and cost-effectively deliver viscose media having a high solid component at high pressures of greater than 200 bar and high temperatures of greater than 300° C.

The object is achieved by a first diaphragm pump head having two or an integral multiple of two fluid delivery chambers and diaphragms associated therewith, which are hydraulically coupled to a second pump head for driving the first diaphragm pump head, wherein the second pump head is a diaphragm pump head which has two additional fluid delivery chambers and two associated additional diaphragms, which are drivable by a double-acting piston, situated in the second diaphragm pump head, via associated diaphragm control chambers, and a refilling valve being connected to each of the diaphragm control chambers, and, using the refilling valves, the diaphragm control chambers being impinged temporarily, during the refilling procedure, which is controlled by the diaphragm position, by a diaphragm control pressure, which is greater than atmospheric pressure and less than the system pressure.

Advantageous embodiments of the present invention are described in the subclaims.

The pump device according to the present invention comprises a first diaphragm pump head having two or an integral multiple of two fluid delivery chambers and diaphragms associated therewith, which are hydraulically coupled to a second diaphragm pump head, the second diaphragm pump head having two additional fluid delivery chambers and additional diaphragms associated therewith, which are drivable by a double-acting piston via associated diaphragm control chambers, a refilling valve being attached to each of the diaphragm control chambers and the diaphragm control chambers being temporarily impinged by a diaphragm pressure, which is greater than atmospheric pressure, using the refilling valves.

Such a pump device is advantageous because at a time at which the refilling valve refills the diaphragm control chambers with a control fluid to compensate for unavoidable leakage of the control fluid, a brief pressure drop in the diaphragm control chambers down to atmospheric pressure, which has been typical up to this point in position-controlled diaphragms, for example, may be limited by the superimposed diaphragm control pressure, which is greater than the atmospheric pressure.

By using the pump device according to the present invention, a movement of the piston is possible at any time using a smaller force than in achievements of the object in the prior art, so that a delivery pressure may alternately be conducted into the particular diaphragm control chambers of the second diaphragm pump head and therefrom to the first diaphragm pump head to transport fluid through the first diaphragm pump head. Although the overall pressure in the first diaphragm pump head may be relatively high to deliver the fluid, it is possible to operate a pumping procedure using a relatively small force exerted on the piston and pressure differential thus generated. A situation thus arises as if the piston would exert the pressure increase directly in the first diaphragm pump head. It is possible due to the pump device according to the present invention that the piston may be driven by a drive assembly which may be designed for much smaller forces than in achievements of the object known up to this point, so that a significantly more cost-effective delivery at high temperatures and pressures in the first diaphragm pump head is achieved.

The pump device is preferably designed in such a way that the diaphragm control pressure approximately corresponds to a fluid pressure at the inlet of a fluid delivery chamber of the first diaphragm pump head. Therefore, the described brief pressure drop in the diaphragm control chamber of the second diaphragm pump head is nearly completely compensated for. In combination with a double-acting embodiment of the piston of the second diaphragm pump head, this has the result that the drive assembly for the piston only has to be designed for forces which approximately correspond to the pressure differential between the inlet and the outlet of a fluid delivery chamber of the first diaphragm pump head.

In the pump device according to the present invention, the diaphragm control pressure may preferably be adapted to the fluid pressure by a control circuit having associated sensors and actuators. In particular with an electronic control circuit, this allows an optimally tailored compensation of the described pressure drop and thus the prevention of pressure surges, which may exert a harmful reaction on the drive assemblies.

The diaphragm control pressure may be generated by a pump which is coupled in each case to a container for a diaphragm control chamber, each container having one of the refilling valves and each container being impinged by a static stagnation pressure by the pump. In such an embodiment, the pump is permanently in operation.

According to an alternative embodiment, the diaphragm control pressure may be generated by a controllable pump which feeds a pressure accumulator which is coupled in each case to a container for a diaphragm control chamber. The container is used in this case as a refilling reservoir. In this embodiment, it is possible that the pump is only in operation when the pressure accumulator falls below a predefined lower limiting pressure. The pump then operates until an upper limit pressure is again reached in the pressure accumulator (two-point regulation).

Furthermore, it is possible to provide a container in each case as a refilling reservoir of a control fluid for a diaphragm control chamber of the second diaphragm pump head, an adjustable throttle device being connected downstream from each container. In this case, the pump may be continuously in operation, so that continuous circulation of a control fluid is provided.

The construction of the pump device and its mode of operation are relatively symmetrical if the piston is implemented as a double-acting disk piston having diametrically opposite piston rods. In this case, the piston faces on both sides of the disk piston having identical sizes, so that during an intake stroke or pressure stroke, the same pressure change and the same volume displacement is generated in each case.

If the diaphragms of the first diaphragm pump head are each freely oscillating metal diaphragms, a fluid may be transported at high temperatures because of the metal material. Because the first diaphragm pump head and the second diaphragm pump head are coupled to a control fluid via lines, these lines may act as cooling lines. Therefore, in a preferred embodiment, the diaphragms of the second diaphragm pump head may be made of a plastic, in particular PTFE, so that there is no danger that these plastic diaphragms will display significant flowing because of too high temperatures.

If the diaphragms of the second diaphragm pump head are each implemented as multilayered and are provided with a position controller and fracture signaling, the security during delivery of the fluid may be increased. Still greater security is achieved if a conductivity or viscosity sensor is provided inside the diaphragm control chambers of the first diaphragm pump head. If a metal diaphragm in the first diaphragm pump head breaks, the fluid to be delivered may reach the neighboring diaphragm control chambers, so that mixing of delivery fluid and control fluid would occur. Mixing of this type may change the electrical conductivity or the viscosity of the mixture in comparison to the values of the control fluid, so that a fracture of a metal membrane may be detected using the sensor.

The hydraulic coupling between the first diaphragm pump head and the second diaphragm pump head may occur using control fluids, which have water or oil. For example, special heat transfer oil may be used as the oil, if the pump device is used for delivering a fluid at high temperatures.

DESCRIPTION OF THE DRAWINGS

In the following, the present invention is described further on the basis of an exemplary embodiment illustrated in the drawing.

FIG. 1 shows a schematic illustration of an embodiment of the pump device according to the present invention.

DETAILED DESCRIPTION

FIG. 1 illustrates a pump device 1 having a first diaphragm pump head 2 and a second diaphragm pump head 8. The first diaphragm pump head 2 has a first diaphragm 3, which separates a first fluid delivery chamber 4 from a first diaphragm control chamber 5. A fluid to be delivered by the first fluid delivery chamber 4 is fed by a supply line 60, in which a fluid pressure p1 exists (see arrow 7), to an inlet opening 6 having an intake valve 61. When the first diaphragm 3 bulges out, the fluid may be transported by the first fluid delivery chamber 4 to a pressure valve 62 at one end of the fluid delivery chamber 4. The membrane 3 bulges out due to the application of a pressure in the first diaphragm control chamber 5. If a pressure which is higher by dp is applied there, a pressure p1+dp exists at the pressure valve 62, using which the fluid is transported to the drain line 63.

The pressure p1+dp is provided through a first line 13 by a second diaphragm pump head 8. This has a second diaphragm 9, which separates a second fluid delivery chamber 10 from a second diaphragm control chamber 11. The second fluid delivery chamber 10 is coupled to the first diaphragm control chamber 5 by a first control fluid 12. When the second diaphragm 9 bulges out, this first control fluid 12 is conducted through the first line 13 to the first diaphragm control chamber 5, so that the first diaphragm 3 bulges out. A displacement of the first control fluid 12 of this type is achieved using a piston 15, which exerts a stroke, which is directed downward in the embodiment shown in FIG. 1. A second control fluid 14 provided in the second diaphragm control chamber 11 is used as the transmission medium of the volume change in an associated lower piston chamber 32. The second diaphragm control chamber 11 extends up to a disk piston 31 of the piston 15, so that the lower piston chamber 32 is a part of the second diaphragm control chamber 11.

The stroke movement of the disk piston 31 in a direction which points downward in the embodiment shown in FIG. 1 is caused by a pump drive assembly 51 using a first piston rod 33. A second piston rod 35 is situated diametrically opposite to the first piston rod 33 on the disk piston 31. Therefore, the disk piston 31 is constructed symmetrically, so that the same area is provided on both diametrically opposite front faces of the disk piston 31. This has the result that during a piston stroke into the lower piston chamber 32, the same absolute value of a pressure and volume change is achieved as during a piston stroke up into a diametrically opposite upper piston chamber 34.

The upper piston chamber 34 is part of a third diaphragm control chamber 17, which is separated from a third fluid delivery chamber 19 by a third diaphragm 18. During a downwardly directed stroke movement of the disk piston 31, the volume of the upper piston chamber 34 enlarges, so that the third diaphragm 18 is contracted or compressed. A third control fluid 16 in the third diaphragm control chamber 17 is used as the transmission medium.

A transport of a fluid conducted at a pressure p1 into the first fluid delivery chamber 4 is achieved if a pressure p1+dp is transmitted into the first diaphragm control chamber 5 via the line 13. Therefore, this pressure p1+dp must also exist in the second fluid delivery chamber 10. This is only possible if such a pressure is built up in the second diaphragm control chamber 11. In achievements of the object according to the prior art, it is typical for a drive assembly to exert this entire pressure p1+dp on one or two single-acting plunger pistons. In contrast, in the embodiment according to the present invention, this is no longer necessary. For this purpose, as is obvious from FIG. 1, the pressure p1 is alternately transmitted via the diaphragms 3 and 24, the control fluids 12 and 21, the diaphragms 9 and 18, and the control fluids 14 and 16 to the particular piston chamber 32 or 34 executing the intake stroke. If the unavoidable leakage of the control fluids 14 and 16 is compensated for by the refilling valves 38 and 40, which are actuated by the diaphragm position controller, a brief pressure reduction down to atmospheric pressure, which is required in principle, occurs in the particular diaphragm control chamber. In the pump device according to the present invention, a pressure p2 is then superimposed on the pressure existing in the diaphragm control chambers 11 and 17, so that the pressure reduction may be compensated for.

If the piston of the second diaphragm pump head is implemented as a double-acting piston and the pressure p2 is approximately equal to p1, only enough force has to be exerted on the piston rod 33 using the pump drive assembly 51 so that the piston 15 generates a differential pressure dp. For example, if p1=250 bar, a transport of the fluid through the first fluid delivery chamber 4 may be achieved using a differential pressure of dp=20 bar. The pump drive assembly 51 therefore no longer has to be designed for p1+dp=270 bar, but rather only for 20 bar. This allows fluid transport which is significantly more favorable economically.

The pressure p2 is provided by a pump 50 via a feed line 36 to the containers 37 and 39. In the case of the refilling procedure controlled by the diaphragm position, the pressure p2 is relayed into the diaphragm control chambers 11 and 17. Excess control fluid is drained via a ventilation valve 42 or 44 into a container 41 or 43, respectively, and conducted using a return line 53 into a control fluid reservoir 52.

During a downwardly directed stroke of the disk piston 31, the upper piston chamber 34 is enlarged, so that the third membrane 18 is compressed. Therefore, the volume of the third fluid delivery chamber 19 also increases, which is coupled via a fourth control fluid 21 and the second line 22 to a fourth diaphragm control chamber 23. The fourth diaphragm control chamber 23 is located in the first diaphragm control head 2 in the embodiment shown in FIG. 1 and is separated using a fourth diaphragm 24 from a fourth fluid delivery chamber 25. This construction is mirror symmetric to the construction having first diaphragm 3, first fluid delivery chamber 4, and first diaphragm control chamber 5. Upon an enlargement of the third fluid delivery chamber 19, the volume of the fourth fluid delivery chamber 25 is also enlarged, so that suction and/or a fluid feed occurs via the image opening 26 having the intake valve 64. If the disk piston is moved in a downwardly directed stroke, the conditions described above are reversed. The fourth fluid delivery chamber 25 delivers a fluid through an outlet opening 28 using a ventilation valve 65 into a drain line 63, while the first fluid delivery chamber 4 is filled.

The first diaphragm 3 and fourth diaphragm 24 are freely oscillating metal diaphragms. A multilayered embodiment and a diaphragm position controller may be dispensed with. A check as to whether a fracture of a metal diaphragm has occurred may be performed indirectly by a conductivity or viscosity sensor 29 or 30. In the event of a fracture of the diaphragm 3, for example, mixing of the fluids occurs in the first fluid delivery chamber 4 and first diaphragm control chamber 5, so that the electrical conductivity or the viscosity changes, which may be detected by the sensors 29 or 30.

For example, in the pump device in the second diaphragm pump head 8, if the third membrane 18 is compressed during an intake stroke of the disk piston 31 in such a way that it reaches its rear position, as noted above, the pressure in the third diaphragm control chamber 17 may drop to and/or below atmospheric pressure. This is undesirable because in this case a significant shear force increase of the piston 15 occurs suddenly and the pump drive assembly is strongly loaded. This may be avoided in the pump device according to the present invention by the permanent pressure impingement using p2, which approximately corresponds to p1, via the containers 37 and 39.

In a further advantageous embodiment (not shown in FIG. 1) the second diaphragm pump head 8 has a separate diaphragm position controller in each case for the second diaphragm 9 and the third diaphragm 18, as disclosed in EP 0 085 725 A1. The particular refilling valves 38 and 40 are replaced by a spring-loaded control plunger, which has an area having a conical face turned into its peripheral face, and a retention rod operationally linked thereto, which in turn releases or blocks a spring-loaded refilling valve. A spring-loaded support plate, which is operationally linked to the control plunger, and which is secured against falling out in the direction of the particular diaphragm 18 or 9 and is provided with through openings for the particular control fluid 16 or 14, is situated in the area of the diaphragm control chamber 17 or 11, respectively. If a loss of the control fluid 16 or 14 has occurred, the final position of the diaphragm 18 or 9 directed in the direction toward the diaphragm control chamber 17 or 11 is displaced, so that the support plate is moved against the spring force which supports it and against the spring for supporting the plunger. The movement of the control plate thus moves the control plunger, so that its conical peripheral area releases the retention rod, this rod falling in the direction of the control plunger longitudinal axis because of gravity, for example. Alternatively, for example, a spring may also force the retention rod in the direction of the control plunger. As a result, the refilling valve is released by the retention rod, so that because of the partial vacuum existing in the particular diaphragm control chamber 17 or 11, the refilling valve is opened against the spring force which supports it and the control fluid 16 or 14 may flow into the diaphragm control chamber 17 or 11, respectively. As soon as the normal control pressure has built up again in the diaphragm control chamber 17 or 11, the previously displaced final position of the affected diaphragm 18 or 19 moves back into the correct final position and thus releases the support plate again, which releases the control plunger and thus displaces the retention rod back into the blocking position, by which the valve is blocked, which is also closed again by the pressure equalization because of its supporting spring.

In addition, it is also possible in another embodiment of the present invention to situate the double-acting piston 15 outside the second diaphragm pump head 8. The piston 15 is situated with the disk piston 31 and the piston rods 33 and 35 in a control-fluid-tight housing separate from the diaphragm pump head 8, which comprises the piston chambers 32 and 34 accommodating the piston 15 as well as flexible or installed lines for the control fluids 16 and 14. These lines connect the particular piston chambers 32 and 34 to the diaphragm control chambers 16 and 11.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A pump device comprising:

a first diaphragm pump head having two fluid delivery chambers and two diaphragm control chambers separated by two diaphragms associated therewith;

a second diaphragm pump head for driving the first diaphragm pump head, the second pump head having two additional fluid delivery chambers and two additional diaphragm control chambers separated by two associated additional diaphragms;

wherein each of the two diaphragm control chambers are separately coupled to one of the two additional fluid delivery chambers to form two separate closed hydraulic couplings between the first diaphragm pump head and the second diaphragm pump head, the closed hydraulic couplings using control fluids which have water or oil;

a double-acting piston situated in the second diaphragm pump head and defining a single piston head that simultaneously acts upon both of the two associated diaphragm control chambers to expand one of the two associated additional diaphragms while contracting the other of the two associated additional diaphragms, the expansion of one of the two associated additional diaphragms driving the control fluid from one of the two additional fluid delivery chambers into one of the two diaphragm control chambers via the closed hydraulic couplings to expand one of the two diaphragms and displace a volume in one of the fluid delivery chambers; and a refilling valve being connected to each of the diaphragm control chambers, and, using the refilling valves, the diaphragm control chambers being impinged temporarily, during a refilling procedure, which is controlled by a position of the two associated additional diaphragms, by a diaphragm control pressure, which approximately corresponds to a fluid pressure at an inlet of the fluid delivery chambers of the first diaphragm pump head.

2. The pump device according to claim 1, wherein the diaphragm control pressure approximately corresponds to a fluid pressure at the inlet of a fluid delivery chamber of the first diaphragm pump head.

3. The pump device according to claim 1, wherein the diaphragm control pressure can be adapted to the fluid pressure by a control circuit having associated sensors and actuators.

4. The pump device according to 1, wherein the diaphragm control pressure is generated by a pump, which is coupled to a container for a diaphragm control chamber, each container having one of the refilling valves and being impinged using a static stagnation pressure by the pump.

5. The pump device according to claim 1, wherein the diaphragm control pressure is generated by a controllable pump, which feeds a pressure accumulator, which is coupled to a container for a diaphragm control chamber.

6. The pump device according to claim 1, wherein a container is provided in each case for a diaphragm control chamber, and an adjustable throttle device is connected downstream from each container.

7. The pump device according to claim 1, wherein the piston is implemented as a double-acting disk piston having diametrically opposite piston rods of equal cross-sectional area.

8. The pump device according to claim 1, wherein the diaphragms of the first diaphragm pump head are each freely oscillating metal diaphragms.

9. The pump device according to claim 1, wherein the diaphragms of the second diaphragm pump head are made of a plastic.

10. The pump device according to claim 1, wherein the diaphragms of the second diaphragm pump head are each implemented as multilayered and are provided with a position controller and fracture signaling.

11. The pump device according to claim 1, wherein a conductivity or viscosity sensor is provided inside diaphragm control chambers of the first diaphragm pump head.

12. The pump device according to claim 9, wherein the plastic is PTFE.

13. The pump device according to claim 1, wherein the diaphragms are hydraulically driven.

14. The pump device according to claim 1, wherein the pump device delivers a viscose media having a high solid component at high pressures of greater than 200 bar.

15. The pump device according to claim 1, wherein the pump device delivers a viscose media having a high solid component at high temperatures of greater than 300° C.

16. A pump device comprising:

a first diaphragm pump head having two fluid delivery chambers and two diaphragm control chambers separated by hydraulically driven diaphragms;

a second diaphragm pump head which has two additional fluid delivery chambers and two additional diaphragm control chambers separated by two associated additional hydraulically driven diaphragms, wherein the two additional fluid delivery chambers of the second diaphragm pump head are hydraulically connected to the diaphragm control chambers of the first diaphragm pump head to form two separate closed hydraulic couplings;

a double-acting piston situated in the second diaphragm pump head defining a single piston head that simultaneously acts upon both of the two associated diaphragm control chambers to drive the two associated additional diaphragms and simultaneously drive the two diaphragms of the first diaphragm pump head via the closed hydraulic couplings between the two additional fluid delivery chambers and the two diaphragm control chambers; and a refilling valve being connected to each of the diaphragm control chambers, and, using the refilling valves, the diaphragm control chambers being impinged temporarily, during a refilling procedure, which is controlled by a position of the two associated additional diaphragms, by a diaphragm control pressure, which approximately corresponds to a fluid pressure at an inlet of the fluid delivery chambers of the first diaphragm pump head.

17. The pump device of claim 1, wherein the hydraulically driven diaphragms of the first diaphragm pump head are configured to oscillate freely.

18. The pump device of claim 16, wherein the hydraulically driven diaphragms of the first diaphragm pump head are configured to oscillate freely.

* * * * *